US006463870B2

(12) United States Patent
Beato et al.

(10) Patent No.: US 6,463,870 B2
(45) Date of Patent: Oct. 15, 2002

(54) MOORING SYSTEM FOR A TENDER FOR PRODUCTION PLATFORMS

(75) Inventors: Christopher Louis Beato, Missouri City; Yi Suang David Tein, Houston, both of TX (US)

(73) Assignee: Drillmar, Inc., Houston, TX (US)

( * ) Notice: Subject to any disclaimer, the term of this patent is extended or adjusted under 35 U.S.C. 154(b) by 0 days.

(21) Appl. No.: 09/847,019

(22) Filed: May 1, 2001

(65) Prior Publication Data

US 2002/0040674 A1 Apr. 11, 2002

Related U.S. Application Data

(60) Provisional application No. 60/238,177, filed on Oct. 5, 2000.

(51) Int. Cl.[7] ..... B63B 21/24
(52) U.S. Cl. ..... 114/293
(58) Field of Search ..... 114/293, 264; 405/195.1, 224

(56) References Cited

U.S. PATENT DOCUMENTS 4,740,106 A * 4/1988 Bianchi et al. ..... 204/196.34
4,797,033 A * 1/1989 Pollack ..... 405/202
5,439,321 A * 8/1995 Hunter ..... 405/195.1
5,558,037 A * 9/1996 Manning ..... 114/264
5,704,307 A 1/1998 Treu
5,885,178 A 3/1999 Luh
5,927,904 A 7/1999 Treu
5,979,353 A * 11/1999 Borseth ..... 114/293
5,992,060 A 11/1999 Treu
6,003,466 A 12/1999 Dove
6,009,825 A 1/2000 Fulton
6,113,315 A 9/2000 Fulton
6,122,847 A 9/2000 Treu

* cited by examiner

*Primary Examiner*—S. Joseph Morano
*Assistant Examiner*—Andrew Wright
(74) *Attorney, Agent, or Firm*—Wendy Buskop; Buskop Law Group, P.C.

(57) ABSTRACT

A mooring system for a semisubmersible tender which comprises a deck, a shape that results in a combined environmental load of less than 1000 kips in a 100-year extreme weather condition, a plurality of supports connected to the deck, a plurality of pontoons connecting to the supports, at least two hawsers for connecting the tender to a production platform, each having adequate elasticity to accommodate the wave frequency between the production platform and the tender, and adequate stiffness to synchronize the average and low frequency movement between the production platform and the tender under an environmental load produced during a storm having a designation of up to a 10-year storm in the tendering position, connectors securing each hawser, a hawser guidance system; and an at least 8-point mooring system with each mooring lines consisting of: a first length of steel wire rope; a length of polymer rope secured to the first length of steel wire rope; a second length of steel wire rope secured to the polymer rope; and creating global equilibrium between the production platform's mooring system and the at least 8 point mooring system of the tender.

8 Claims, 5 Drawing Sheets

MOORING SYSTEM FOR A TENDER FOR PRODUCTION PLATFORMS

This application claims the benefit of priority of co-pending provisional application Serial No. 60/238,177, filed in the United States Patent and Trademark Office on Oct. 5, 2000.

BACKGROUND OF THE INVENTION

Field of the Invention

This invention relates to a unique mooring system for a particular semisubmersible tender that facilitates the servicing of off shore oil and natural gas production platforms.

The present invention specifically relates to the method and apparatus of the mooring system for a semisubmersible tender which tender can be secured to different types of production platforms, such as a tension leg platform (TLP), a deep draft cassion vessel (SPAR), a fixed platform, a compliant tower, a semisubmersible production vessel, or a floating vessel.

BACKGROUND OF THE INVENTION

Natural gas and oil production platforms typically lack adequate space for all the drilling equipment needed to safely drill a well and store drilling equipment and materials in an environmentally conscientious manner. Tenders have often been called into service to provide the required space needed on a rig and/or platform after the initial drilling phase of an oil lease and during maintenance of a well. Problems have traditionally existed in that most tenders cannot be kept alongside a platform in a constant spaced relationship during extreme weather because of inadequate mooring systems which do not prevent collision of the tender with the platform.

Specifically, tenders have not been able to remain in a connected capacity while moored and simultaneously avoid the risk of collision while enduring an environmental load of up to a 10 year storm, see for example the inventions of U.S. Pat. Nos. 4,065,934, and 4,156,577, which are hereby incorporated by reference.

It should be noted that most tenders have had to be completely towed away from the production platforms and be disconnected from their moorings when a tropical storm or extreme weather arises, which causes considerable expense to the drilling contractor and/or customer.

Until the existence of this invention as described herein, it has been generally believed to be impossible to safely moor a semisubmersible tender to a floating production platform in water depths exceeding several hundred feet.

The present invention is a mooring system for and method of mooring a semisubmersible tender. A mooring system has long been needed which enables the tender to be kept a constant distance from a production platform while enabling a tender to synchronize to the low and mean movement frequencies of the production platform. The mooring system of the invention permits the tender to sustain an environmental load of wind, current and wave forces of up to a 100-year cyclonic storm (such as a hurricane) in a 100-year extreme weather standby position, and up to a 10-year storm in a tendering position.

SUMMARY OF THE INVENTION

The invention relates to a mooring system for a semisubmersible tender for use with a production platform in the initial drilling phase of a well. It is also a mooring system for a tender doing maintenance on a well.

The invention relates to an at least 8-point mooring system for a semisubmersible tender which uses at least 8 anchors; at least 8 mooring lines, with each line consisting of: a first length of steel wire rope secured to each of the anchors; a length of polymer rope secured to each of the first length of steel wire rope; a second length of steel wire rope having a first and second end, and wherein the first end is secured to the length of polymer rope and the second end is secured to the tender. Each mooring line has sufficient elasticity, stiffness and strength to accommodate an environmental load produced by up to a 10-year storm while the tender is moored in the tendering position, and each mooring line has sufficient elasticity, stiffness and strength to withstand an environmental load produced by up to a 100-year extreme weather condition when the tender is moved to a 100-year extreme weather condition standby position. The mooring system enhances the global equilibrium between the production platform's mooring system and the at least 8 point mooring system usable with the semisubmersible tender.

DETAILED DESCRIPTION OF THE PREFERRED EMBODIMENTS

The mooring system of the invention can be used on a semisubmersible tender, which can be used with a variety of production platforms, including fixed production platforms and floating production platforms. Typical production platforms are deep draft cassion vessels (SPARs), tension leg platforms (TLPs), compliant towers, semisubmersible production vessels, other floating ships, and other floating semisubmersibles.

The invention relates to a mooring system for a certain type of semisubmersible tender. The mooring system with the tender shape and features enables the successful elimination of the risk of collision between the tender and the production platform in up to a 10-year winter storm in the operational mode, thereby significantly improving the health, safety and operating environment on the production platform while enabling the continuing drilling or production operation during difficult weather conditions. The criteria for a 1-year, 10-year, and 100-year storm is set forth in the Deepstar Metocean Report which is a well-known industry standard.

The invention's mooring system (i) enables a predictable operational weather window, matching or exceeding that of either a platform rig or a jack up rig; (ii) virtually eliminates the risk of collision damage during all operational events; and (iii) enables the unit to quickly evacuate the production platform in case of an emergency.

The at least 8-point mooring system for the tender comprises:

a. at least 8 anchors;

b. at least 8 mooring lines, each line consisting of: a first length of steel wire rope secured to each of the anchors; a length of rope secured to each of the first length of steel wire rope; a second length of steel wire rope having a first and second end, and wherein the first end is secured to the length of rope and the second end is secured to the tender; and wherein each mooring line has adequate elasticity, stiffness and strength to accommodate load on the tender under an environmental load produced by an up to a 10-year storm in the tendering position, and further the mooring lines have a strength to withstand the environmental load produced by up to a 100-year extreme weather condition when the tender is moved to a 100-year extreme weather condition standby position.

Figure 1:
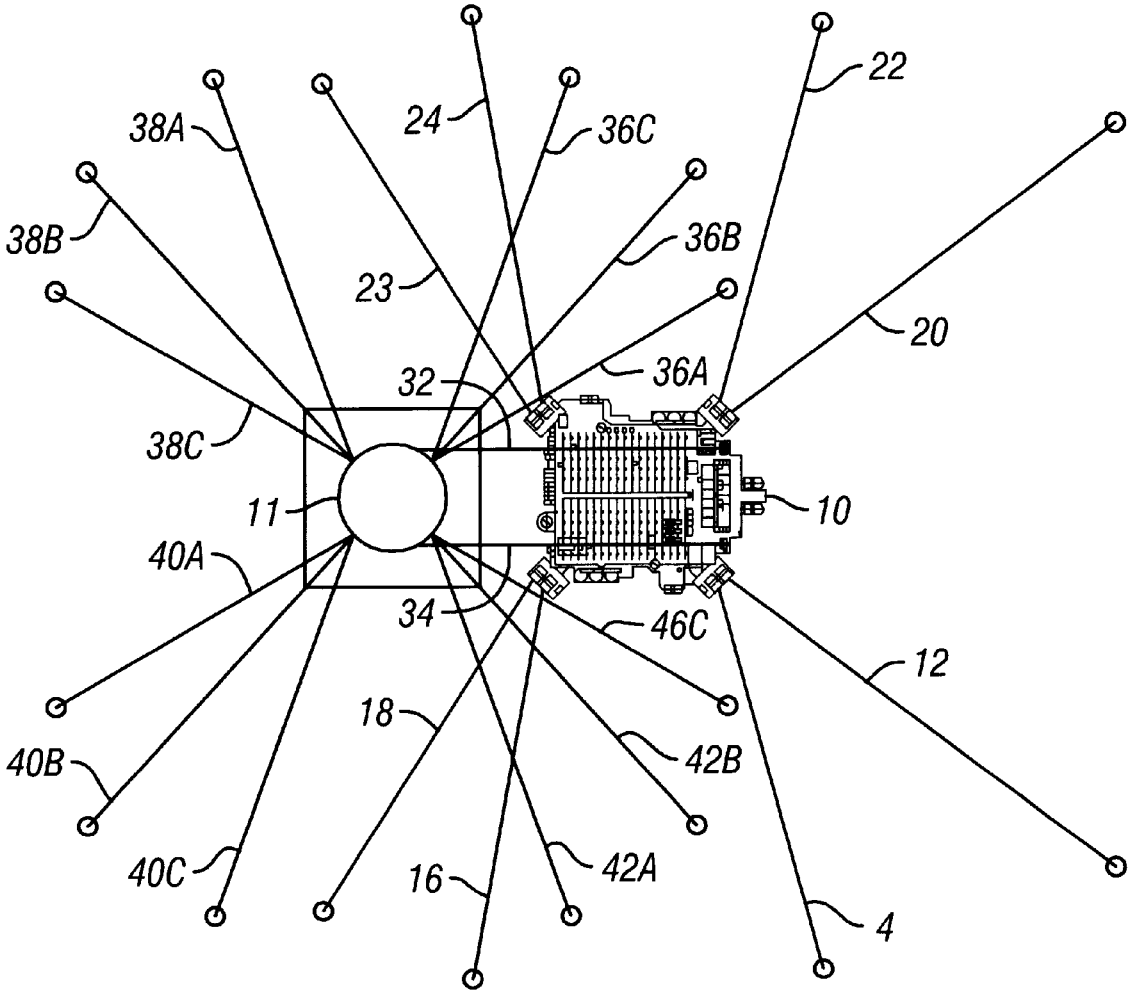
FIG. 1 is a top view of the moored tender secured to a production platform known as a SPAR.

Referring now to FIG. 1, the tender 10 can be moored with at least 8 mooring lines, 12, 14, 16, 18, 20, 22, 23 and 24. It is contemplated that the mooring system of the invention can be installed by first placing anchors in the sea floor, then attaching mooring lines to the anchors, placing a buoy on the mooring line secured to each anchor, and then attaching the mooring lines to the tender. A particular embodiment for a tender's mooring system in relation to a SPAR is shown in FIG. 1.

For a SPAR 11, the tender 10 is secured to the SPAR 11, using at least two hawsers, 32 and 34. This production platform is also known as a deep draft cassion vessel. It should be noted that a SPAR is typically moored with 12 to 16 mooring lines in four cluster groups. Mooring lines are shown as 36*a*, 36*b*, 36*c*, 38*b*, 38*c*, 40*a*, 40*b*, 40*c*, 42*a*, 42*b* and 42*c*.

Figure 2:
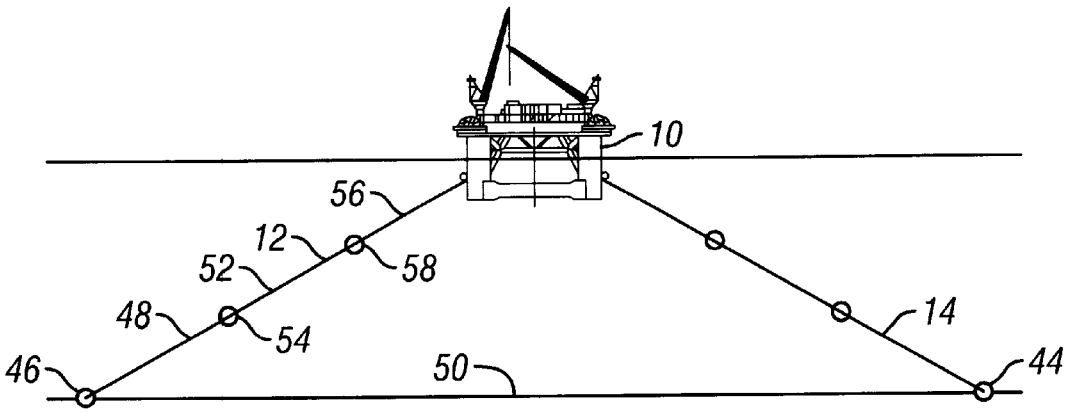
FIG. 2 shows mooring line orientations on a production platform.

FIG. 2 shows one example of the invention, where the tender 10 is moored to the sea floor 50 in 6000 ft of water. Two mooring lines 12 and 14 of the at least 8 mooring lines are shown secured to anchors 44 embedded in the sea floor 50. A vertical loaded anchor 44 is preferred as an anchor to moor the tender to the sea floor. Another usable anchor is a plate anchor, as described in U.S. Pat. No. 6,122,847 and hereby incorporated by reference. Alternatively, a piled anchor which is suction installed can be used as the mooring anchor for the tender. The anchor 44 is secured on one end to mooring line 14. A second anchor 46 is shown secured on one end to mooring line 12. On the other end, is secured to a first length of steel rope 48, which is termed "anchor wire rope."

For an example, where the tender is moored to a SPAR in 6000 feet of water, the length of the anchor wire rope 48 is typically 1500 feet and has a preferred outer diameter of 4½ inches. The breaking strength of anchor wire rope 48 is at least 2061 kips.

Anchor wire rope 48 is connected to a polymer rope 52, which is most preferably a polyester rope made by Marlow, UK, or Whitehill Manufacturing Corporation, U.S.A., or CSL (Cordvaia) of Saul Leopoldo, Brazil. The length of the polymer rope 52 is preferably 5,500 feet with a preferred outer diameter of 7.1 inches. When the tender is in 6000 feet of water, the outer diameter of this rope can be varied between 4 and 10 inches and still remain usable in this invention. The breaking strength of the polymer rope 52 should be at least 2300 kips. A buoy 54, preferably having a net buoyancy of at least 40 kips and up to 100 kips, is secured to the polymer rope 52 to keep the mooring line 12 off the sea floor 50.

In an embodiment where the water has a 1760 feet depth, it is contemplated that the mooring system can use pre-installed segments, which include suction installed pile anchors or high performance drag embedment anchors. For 1760 feet of water, the anchor wire rope 48 is preferably 500 to 550 feet long with an outer diameter of about 4 and $\frac{7}{8}^{th}$ inches and a six-strand construction. Connected to the anchor wire rope 48 is rope 56, which preferably is about 3100 feet long and has a 7½-inch OD, with a parallel strand construction. Optionally, a second buoy 58, having 40-kip net buoyancy, can be secured to the new rope 56.

The rope 56 is connected at the end opposite the polymer rope to a second steel rope 60, known in the industry as a "vessel wire rope." For a 1760-foot water depth embodiment, this rope is approximately 3000 feet long having an outer diameter of 4 and ⅞ inches. The breaking strength of the rope is at least 2300 kips with a 1¹⁄₁₆ inch corrosion allowance. A preferred vessel wire rope 60, can be obtained from Diamond Blue. Vessel wire rope 60 is secured at the other end to tender 10. A high strength six-strand construction is preferred for the vessel wire rope 60.

It should be noted that even though polyester rope is the most preferred for polymer rope 452, other polymer ropes are contemplated as usable herein, including but not limited to polypropylene rope, polyethylene rope, polybutylene rope and combinations thereof. The construction of the polymer rope can range from parallel strand construction to wound multiple strand constructions as is generally know in the maritime industry. It should also be noted that at least 8 mooring lines are preferred, but 7 lines can be used with one broken. In other embodiments, more mooring lines could be used. When 9 or more mooring lines are used instead of 8 mooring lines, the individual thickness of the mooring lines can be reduced while maintaining the required design safety factors for the tender.

Figure 3:
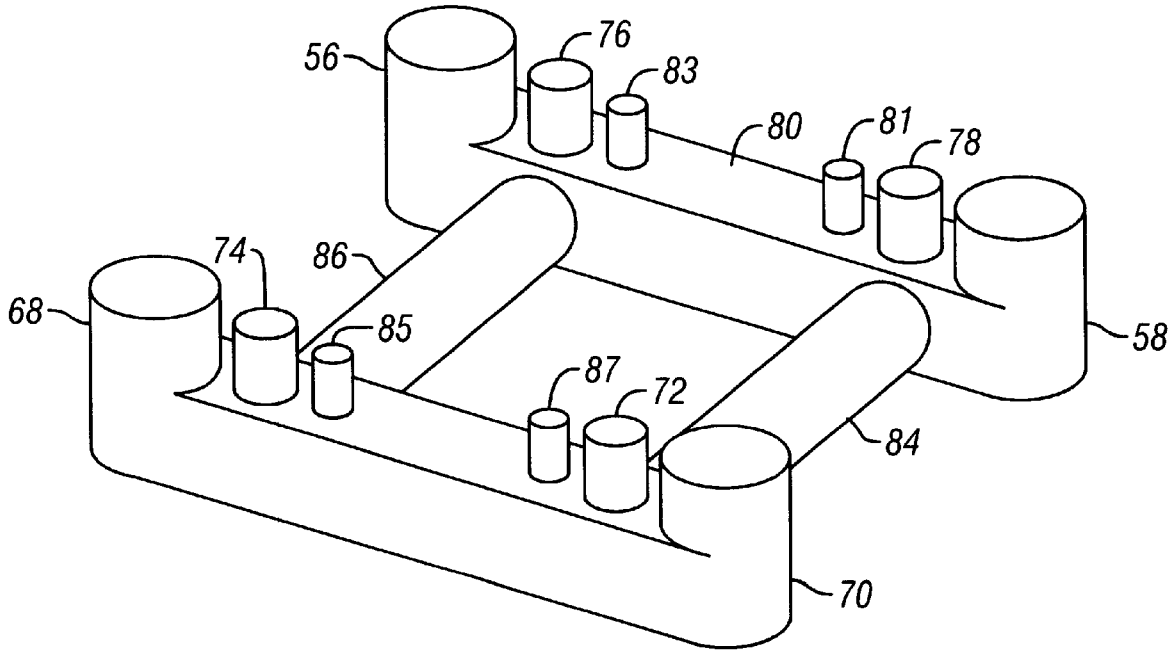
FIG. 3 is a perspective view of one embodiment of the tender of the invention.

FIG. 3 shows a view of the semisubmersible tender 10 having 8 supports 56, 58, 68, 70, 72, 74, 76, and 78. In the most preferred embodiment, the supports are structures with rounded edges or round shapes, such as columns. The deck is attached to these columns. In this Figure a rectangular shape is shown, but the tender is most preferably constructed in a ring design, with between 3 to 12 column supports. 8 rounded supports are shown as four large rounded supports as 56, 58, 68, and 70, and four smaller rounded supports are shown as 72, 74, 76 and 78. At least two pontoons 80 and 82 are shown in this embodiment. Each is capable of being ballasted. Preferably, each pontoon, if used, has rounded edges. In one embodiment, each pontoon is designed to have a stern and bow. Secured to the pontoons are at least two buoyant transverse cross members 84 and 86, which are generally kept void but may be quickly ballasted. The pontoons are capable of transferring ballast quickly between pontoons and columns. The contemplated quick transverse ballast transfer is at a rate between about 30 and 300 gallons per minute, and preferably, 80 to 300 gallons per minute, and the quick longitudinal ballast transfer is between about 180 and 300 gallons per minute.

Figure 4:
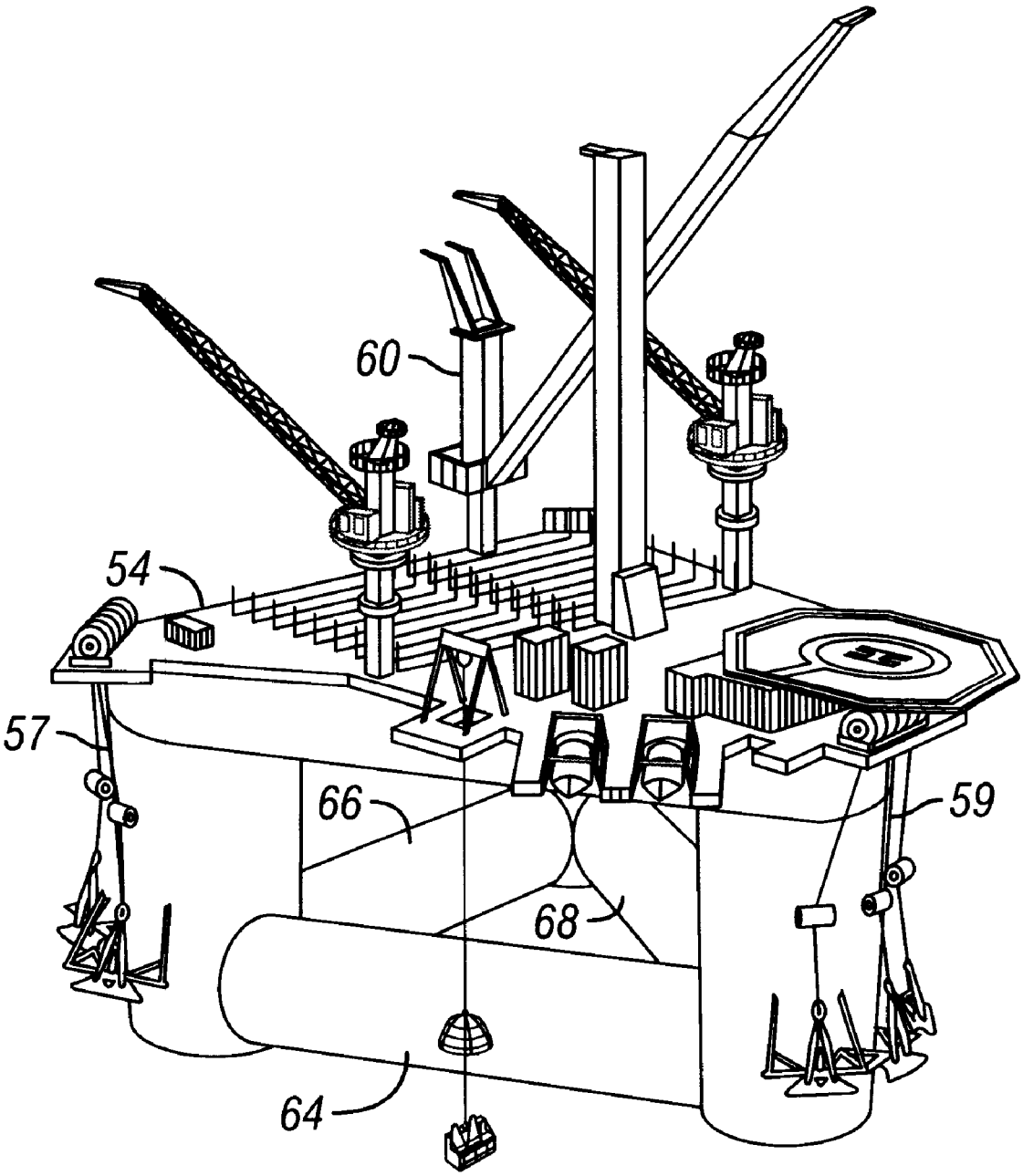
FIG. 4 is a perspective view of a tender having a ring design usable with the invention.

FIG. 4 shows an alternative construction of a tender usable with this mooring system using cross members 64, 66 and 68 in a triangle shape connecting between columns 57 and 59. In one embodiment, at least one of these supports comprises a portion of the periphery of the deck of the tender. Cranes 60 can be placed on the deck 54. It should be noted that it is within the scope of the invention that this tender be self propelled or capable of being towed to a position near a production platform. The semisubmersible tender of the invention preferably has at least 3 and up to 12 supports with a rounded shape. In the most preferred embodiment, the columns are assembled in a triangular ring design, though circular, square or rectangular shaped extenders.

The preferred tender usable with the mooring system is constructed to have a size and shape which results in a combined environmental load of less than 1,000 kips within a 100-year extreme weather condition, such as a hurricane when one of 8 mooring lines is damaged and when the tender is in the standby position. The preferred tender shape results in a combined environmental load of less than 600 kips within a 10-year storm when secured to a production platform, like a SPAR, with one mooring line damaged, in a tendering position with 40 to 60 feet of consistent clearance between the tender and the production platform.

In a preferred embodiment, it is contemplated that the supports can contain traditional and non-traditional items. In one embodiment it is contemplated that when certain non-traditional items are used, they can be used to lower the center of gravity of the tender for additional stability. These items can include filled tanks of sterile brine completion fluids and ballast transfer equipment, bulk storage tanks, drilling and storage tanks, fluid tanks; ballast control systems; mooring line storage reels, transfer equipment for fluids in the designated tanks and combinations thereof. Specifically, the mooring storage line reels are used, they can be connected to winches within the supports, thereby lowering the center of gravity of the tender. The mooring winch storage can also be disposed in the supports to lower the center of gravity of the tender.

The mooring system for the tender is capable of maintaining a safe clearance between the platform and the tender under operating conditions, up to the 10-year winter storm or up to the 10-year loop current condition in the Gulf of Mexico.

The mooring system is designed to withstand the 100-year hurricane and yet maintain a safe clearance with a production platform under a scenario where all mooring lines are intact or under a scenario wherein one mooring line is damaged.

Figure 5:
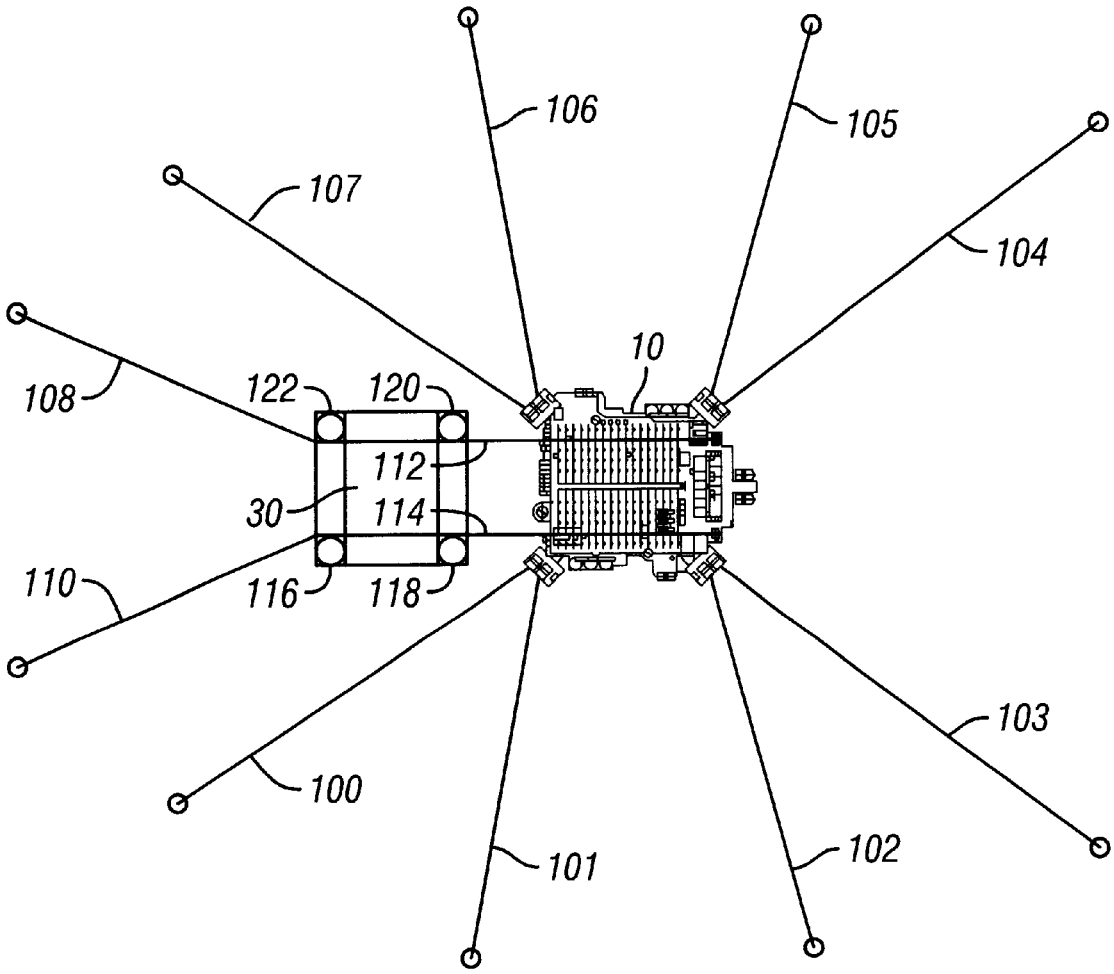
FIG. 5 is a top view of a tender moored to a tension leg platform.

FIG. 5 shows a preferred mooring line orientation for the semisubmersible tender when secured to a TLP. Mooring line 100 is oriented about 45 degrees from mooring line 102 when in the hurricane standby position. The tender's mooring lines are 100, 101, 102, 103, 104, 105, 106 and 107. The TLP's auxiliary mooring lines are tensioning lines 108 and 110. The hawsers are 112 and 114. Support columns for the TLP are 116, 118, 120, and 122.

In one embodiment of the invention the mooring system consists of 8 spread-mooring legs connecting the tender to the sea floor. However, 9 mooring lines could be used or even 12–14 mooring lines could be used for the anchoring tender. In a preferred embodiment, all mooring lines are kept taut.

Figure 6:
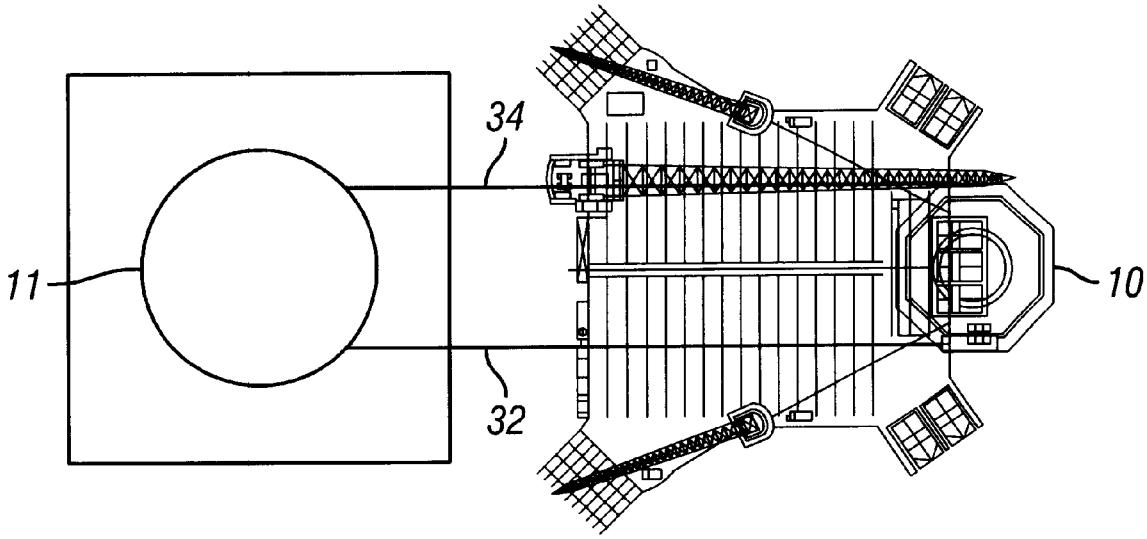
FIG. 6 is a top view of a tender secured to a SPAR with two hawsers.

In FIG. 6, tender 10 is shown connected to the production platform 11 using at least two hawsers 32 and 34, with each hawser being constructed from a polyamide, such as a nylon.

The hawser lines 32 and 34 preferably have a diameter of 5.5 inches. The diameter of a hawser can range from 3 to 7 inches, and the length of the hawser can vary depending on the type of production platform the tenders are tied to as well as the anticipated severe weather conditions. Each hawser has a length, which is selected from the group: the length of the tender, the tendering distance, the length of the semisubmersible production vessel, and combinations thereof. The hawser is preferably rated for up to 1000 kips breaking strength.

Hawsers are connected to a connecting means such as hawser winches, which are capable of variable payout for connecting a tender to a production platform. Alternatively, the connecting means can be a hawser wire rope that winds on a hawser winch. A preferred nylon hawser is made from fibers made by the E.I. DuPont Company of Wilmington, Del.

The hawser line of the tender should have adequate elasticity to accommodate the different wave frequency movement between tender and production platform, but be stiff enough so that the tender and production platform mean and low frequency movements can be synchronized, thereby enabling the tender to move in substantially identical mooring watch pattern shapes, such as a figure eight mooring watch pattern or an elliptically shaped mooring watch pattern.

It is preferred that the hawsers have adequate elasticity to accommodate the wave frequency movements between the production platform and the tender, and adequate stiffness to synchronize the mean and low frequency movement between the production platform and the tender under an environmental load produced during a storm having a designation of up to a 10-year storm in the tendering position, and wherein said hawsers remain slack during a storm designated as at least a 10-year storm for the tender in the tender standby position.

The inventive mooring system permits the tender to synchronize between the around 10–12 seconds mean and low frequency excursions. in periods. The inventive system allows the tender to cope with the relative wave frequency motions which can range from 3 to 20 seconds in full cycle period by optimizing the elasticity of the mooring lines. The invention enables a safe clearance, of at least 35 and up to 50 feet to be maintained between the production platform and the tender during all possible tendering conditions, whether or not one mooring line is damaged or all lines are intact.

A usable safe operating distance is considered between 35 and 100 feet, and preferably is at least 40 feet and, more typically, 50 feet of safe clearance in normal weather and current (which can include a sudden squall, a 1 year winter storm and a 1 year loop current).

The tender usable with this mooring system preferably has a size with at least 15,000 square feet and up to about 40,000 square feet of deck space most preferably, 25,000 square feet.

The tender will be moored using the method in one of three positions relative to the production platform: (i) extreme weather standby (for cyclone storms); (ii) tender standby for weather conditions of 10-year storms, or greater; and (iii) operating tender for weather conditions up to a 10-year storm.

It is possible there may be a benign weather condition mooring position as well, which could bring the tender within 35 feet of the production platform.

When in the extreme weather standby mode, the hawsers are slacked, then the hawsers are released and the tender is winched away to a safe distance supported by the mooring system, so that no collision occurs between the production platform and the tender. The extreme weather standby mode is used in not only the 100-year winter storm mode, but in a 100-year hurricane standby position or when a 100-year loop current causes severe current, wave, and related extreme weather conditions. The safe clearance distance maintained by the tender in the extreme weather tender standby mode is preferably at least 200 feet for the 100-year winter storm, and at least 500 feet for the 100-year hurricane and up to 1000 feet when moored in extremely deep water.

For the tender standby mode, such as in weather which is up to a 10-year storm, the tender remains moored and connected to the platform with the hawsers, but the tender is maintained at a distance of between about 200 and 500 feet using the mooring system.

It should be noted that the mooring lines conform to API standard RP-2SK.

The vessel is moored to the sea floor using an at least 8-point mooring system. This mooring system preferably has: (a) at least 8 anchors; and (b) at least 8 mooring lines, each line consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein said mooring line has adequate elasticity, stiffness and strength to accommodate the load on said tender under an environmental load produced by an up to a 10-year storm in the tendering position, and further wherein said mooring lines have a strength to withstand the environmental load produced by up to a 100-year extreme weather condition when said tender is moved to a 100-year extreme weather condition standby position.

In the most preferred embodiment, the mooring lines are tensioned while the hawsers connect the tender to the platform.

Variations can occur within the scope of this invention. For example, it is contemplated that the 8-point mooring system for the tender could be a damaged 8-point system, that is, a 7-line mooring system with one broken line and yet still work within the scope of the invention.

Further features and advantages of the invention will be apparent from the specification and the drawing.

What is claimed is:

1. A mooring system for a semisubmersible tender with a lightship displacement of less than 15,000 short tons for a deep draft caisson vessel (SPAR) comprising:

a. at least 8 anchors;

b. at least two hawsers connected from a semisubmersible tender to a deep draft caisson vessel; and c. at least 8 mooring lines, each line consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein said mooring line has adequate elasticity, stiffness and strength to accommodate the load on said tender under an environmental load produced by an up to a 10-year storm in the tendering position, and further wherein said mooring lines have a strength to withstand the environmental load produced by up to a 100-year extreme weather condition when said tender is moved to a 100-year extreme weather condition standby tender is moved to a 100-year extreme weather condition standby position; and said lines are adapted to synchronize the movements between said semisubmersible tender and said deep draft caisson vessel, while tendering.

2. The mooring system of claim 1, wherein said mooring lines are tensioned.

3. A mooring system for a semisubmersible tender with a lightship displacement of less than 15,000 short tons for a tension leg production platform (TLP) comprising:

a. at least 8 anchors;

b. at least two hawsers connected from a semisubmersible tender to a tension leg production platform; and c. at least 8 mooring lines, each line consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein each said mooring line has adequate elasticity, stiffness and strength to accommodate load on said tender under an environmental load produced by an up to a 10-year storm in the tendering position, and further wherein said mooring lines have a strength to withstand the environmental load produced by and up to 100-year extreme weather condition when said tender is moved to a 100-year extreme weather condition standby position; and said lines are adapted to synchronize movements between the semisubmersible tender and the tension leg production platform, while tendering.

4. The mooring system of claim 3, wherein said mooring lines are tensioned.

5. A mooring system for a semisubmersible tender with a lightship displacement less than 15,000 short tons for a compliant tower production platform having a steel structure extending to the sea floor, comprising:

a. at least 8 anchors;

b. at least two hawsers connected from a semisubmersible tender to a compliant tower production platform; and c. at least 8 mooring lines, each consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein said mooring line has adequate elasticity, stiffness and strength to accommodate the load on said tender under an environmental load produced by up to a 10-year storm in the tendering position, and further wherein said mooring lines have a strength to withstand the environmental load produced by a 100-year extreme weather condition when said tender is moved to a 100-year extreme weather condition standby position; and wherein said lines are adapted to synchronize the movements between the semisubmersible tender and the compliant tower production platform, while tendering.

6. The mooring system of claim 5, wherein said mooring lines are tensioned.

7. A mooring system for a semisubmersible tender with a lightship displacement of less than 15,000 short tons for a fixed leg production platform, comprising:

a. at least 8 anchors;

b. at least two hawsers connected from a semisubmersible tender to a fixed leg production platform; and c. at least 8 mooring lines, each consisting of: a first length of steel wire rope secured to each of said anchors; a length of polymer rope secured to each of said first length of steel wire rope; a second length of steel wire rope having a first and second end, and wherein said first end is secured to said length of polymer rope and said second end is secured to the tender; and wherein said mooring line has adequate elasticity, stiffness and strength to accommodate the load on said tender under an environmental load produced by an up to 10-year storm in the tendering position, and further wherein said mooring lines have a strength to withstand the environmental load produced by up to a 100-year extreme weather condition, when said tender is moved to a 100-year extreme weather standby position; and said lines are adapted to synchronized movements between the semisubmersible tender and said fixed leg production platform.

8. The mooring system of claim 7, wherein said mooring lines are tensioned.

* * * * *